United States Patent [19]

Sodergard

[11] Patent Number: 4,640,666

[45] Date of Patent: Feb. 3, 1987

[54] CENTRIFUGAL PUMP

[75] Inventor: Bengt Sodergard, Upplands Vasby, Sweden

[73] Assignee: International Standard Electric Corporation, New York, N.Y.

[21] Appl. No.: 751,472

[22] Filed: Jul. 3, 1985

Related U.S. Application Data

[63] Continuation of Ser. No. 535,109, Sep. 23, 1983, abandoned.

[30] Foreign Application Priority Data

Oct. 11, 1982 [SE] Sweden ..... 8205774

[51] Int. Cl.[4] ..... B02C 18/40

[52] U.S. Cl. ..... 415/121 B; 415/143; 415/213 A; 241/46.11

[58] Field of Search ..... 415/121 B, 143, 213 A; 241/46.06, 46.08, 46.11

[56] References Cited

U.S. PATENT DOCUMENTS

| | | | |
|---|---|---|---|
| 3,560,106 | 2/1971 | Sahlstrom | 415/121 B |
| 3,961,758 | 6/1976 | Morgan | 415/121 B |
| 4,108,386 | 8/1978 | Conery et al. | 241/46.11 |
| 4,222,528 | 9/1980 | Smith | 241/46.08 |
| 4,378,093 | 3/1983 | Keener | 415/121 B |
| 4,402,648 | 9/1983 | Kretschmer | 415/121 B |
| 4,454,993 | 6/1984 | Shibata et al. | 241/46.11 |

FOREIGN PATENT DOCUMENTS

| | | | |
|---|---|---|---|
| 0587706 | 1/1959 | Italy | 415/121 B |
| 58-38396 | 5/1983 | Japan | 415/121 B |

*Primary Examiner*—Everette A. Powell, Jr.

*Attorney, Agent, or Firm*—John T. O'Halloran; Mary C. Werner

[57] ABSTRACT

The invention concerns a centrifugal pump for pumping heavily polluted liquids. The impeller is provided with an inlet having cutting means cooperating with an inlet opening of the pump housing, which cutting means cut elongated bodies, such as rags before they get into the pump housing.

5 Claims, 3 Drawing Figures

CENTRIFUGAL PUMP

This application is a continuation of application Ser. No. 535,109, filed Sept. 23, 1983, now abandoned.

BACKGROUND OF THE INVENTION

This invention concerns a centrifugal pump for pumping liquids containing solid bodies, such as rags and other elongated objects.

The centrifugal pump which draws in the liquid at its center and throws it outwardly in the peripheral direction has good abilities when pumping fairly clean liquids. If the liquid contains solid bodies, however, the problem occurs that these may be stuck between the impeller and the surrounding pump housing and cause a stop or at least a decreased pumping ability.

A method to solve these problems is to design the pump so that the impeller rotates beside the liquid flow, a so-called vortex impeller. The stopping problems are mainly solved by this design, but other disadvantages, such as a decreasing efficiency, occur.

Another method to solve the problem is to arrange some sort of a cutting means in front of the impeller which cuts rags and such things so they become possible to pump. An example of such a construction is shown in U.S. Pat. No. 4,108,386.

In this known design the front end of the impeller is provided with two cutting means, which cooperate with the inlet of the pump housing for cutting up the pollutants. This construction, however, does not work satisfactorily due to the fact that the underpressure prevailing in the pump inlet causes an incoming rag to be drawn into the impeller center. Smaller rags may then rotate with the impeller and never make contact with the cutting means. Bigger rags may bring about an increasing rotation opposition which can stop the pump.

SUMMARY OF THE INVENTION

In general, it is an object of the present invention to avoid the disadvantages of the prior art.

It is a further object of the present invention to provide a pump having an impeller which is designed to avoid clogging by solid objects such as rags and other elongated objects.

In pursuance of these objects, one feature of the present invention resides in the provision of a pump comprising a pump housing having an internal surface bounding a central inlet and provided with grooves and an impeller having at least a portion received in the inlet for rotation therein, the portion being substantially cylindrical and having a diameter which is smaller than that of the inlet, the portion having substantially axially extending cutting means which project radially from the portion to cooperate with the grooves to cut solid objects such as rags and other elongated objects.

BRIEF DESCRIPTION OF THE DRAWING

Above-mentioned and other features and objects of the invention will become more apparent by reference to the following description taken in conjunction with the accompanying drawing in which.

DESCRIPTION OF THE PREFERRED EMBODIMENT

Figure 1:
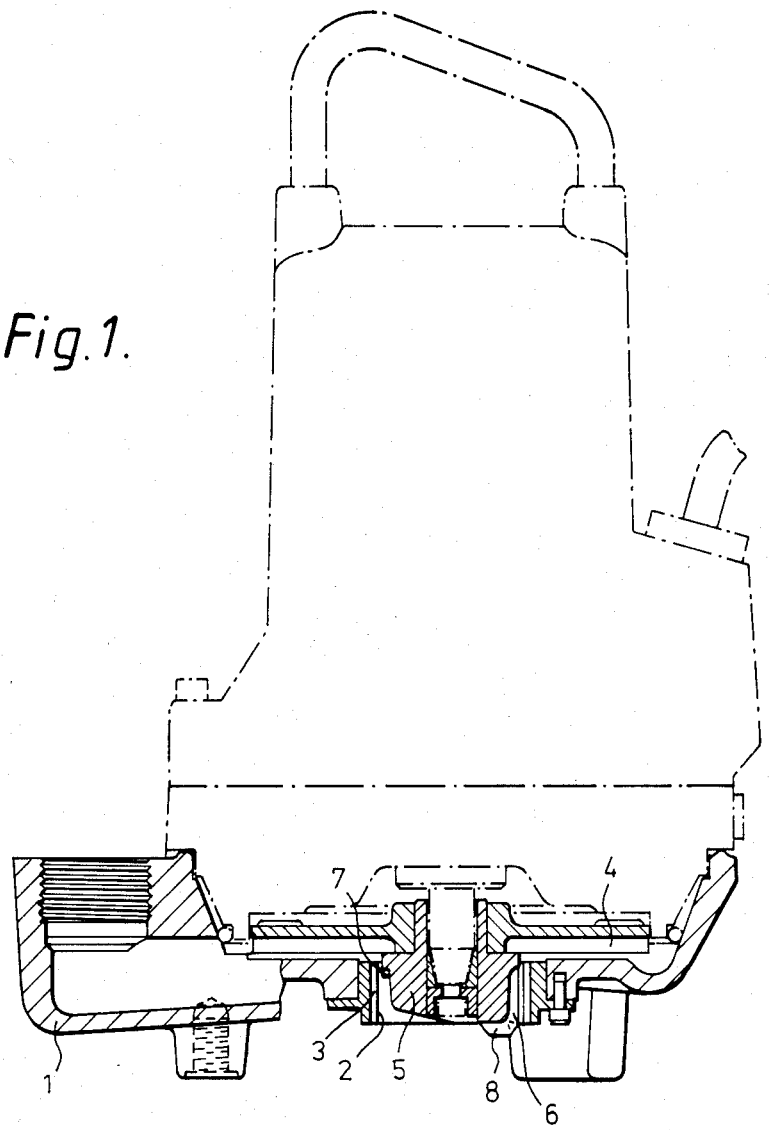
FIG. 1 shows a sectional view of the invention seen radially.
Figure 2:
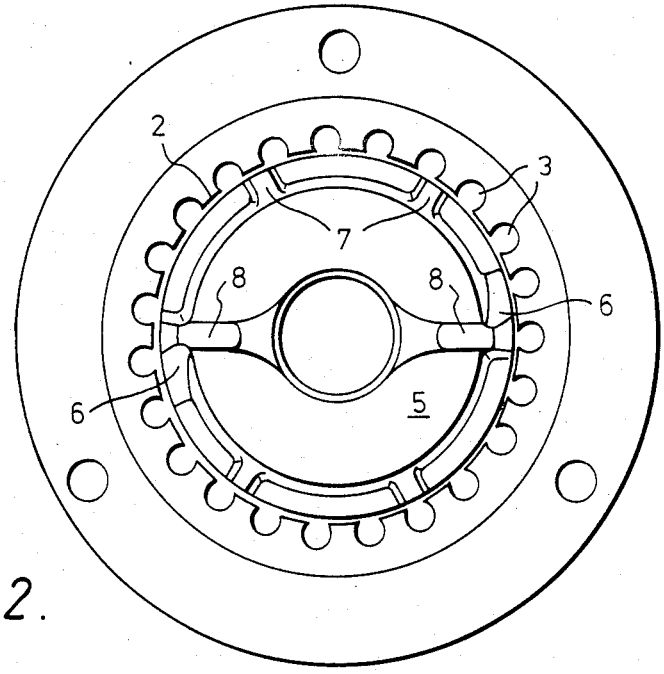
FIG. 2 shows the invention from an axial direction.
Figure 3:
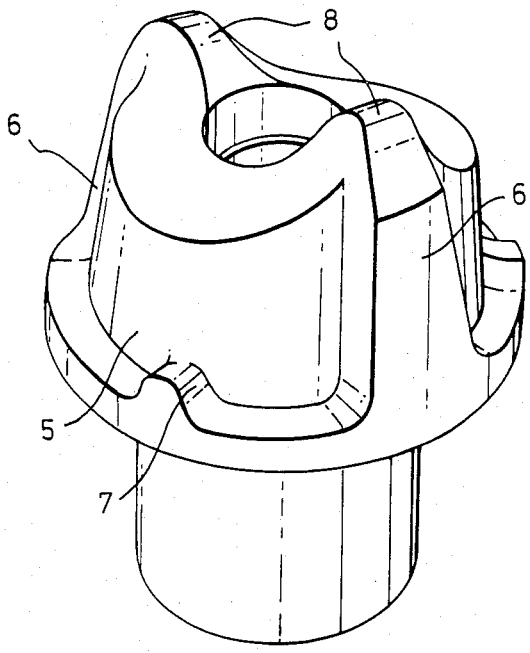
FIG. 3 shows a perspective view of an inlet part of an impeller according to the invention.

In the Figures, a pump housing 1 has an inlet opening 2 provided with grooves 3. A centrifugal impeller 4 is provided with an inlet part 5, primary cutting means 6, secondary cutting means 7 and projections 8. The inlet part 5 of the impeller 4 is cylindrical and projects down into the inlet opening 2 of the housing 1. On the periphery of the inlet part 5 there are provided the cutting means 6, preferably including two cutting portions which are arranged essentially axially and somewhat inclined towards the projections 8 and project up to the edge of the inlet opening 2. The cutting means 6 cooperates with the axially directed grooves 3 in the inlet opening 2, causing any solid objects such as rags and other elongated objects which may be included in the medium and constituting pollutants of such medium to be cut in the area between the inlet part 5 and the inlet opening 2. Intermediate the cutting means there is a distance between the periphery of the inlet part 5 and the inlet opening 2, which decreases the risk of development of underpressure at the impeller center which, if permitted to develop, would have certain disadvantages mentioned above. The radius of the inlet part 5 is about 75–95%, preferably 80–85%, of the radius of the inlet opening 2. A larger distance could mean that a plurality of pollutants could contact the cutting means 6 at the same time.

Some portions of the inlet part 5 project a distance outside the inlet opening 2. These portions or projections 8 are rounded as are the sections between them, giving the front surface of the inlet part 5 a wave form. The projections 8 are preferably arranged axially in front of the cutting means 6 as considered in the direction of flow, but may also be arranged in some other way.

The purpose of the projections 8 is primarily to create a flow pattern in front of the impeller 4 which prevents rags or other elongated objects constituting the pollutants from being drawn into the center of the impeller and directs them towards the cutting means 6 arranged at the periphery of the impeller 4.

In order to obtain further dispersion of the pollutants which have been cut by the above-mentioned cutting means 6, there is preferably further provided a number of secondary cutting portions together constituting secondary cutting means 7 which projects up to the edge of the inlet opening 2.

According to the invention there is thus obtained a cutting device for centrifugal pumps which in a simple and effective way disintegrates pollutants in the pumped medium, without engendering the risks for clogging from which the prior known devices have suffered. In the description above, an embodiment with two primary cutting portions constituting the cutting means 6 has been described. However, if larger impeller diameters are being used, it is possible to use an increased number of cutting portions constituting cutting means 6 and a larger number of projections 8, all within the scope of the invention.

I claim:

1. A centrifugal pump for pumping liquids containing solid objects, such as rags and other elongated objects, comprising a pump housing having an internal surface bounding an inlet opening and provided with grooves; and an impeller having a part thereof received in said inlet opening for rotation therein, said part having a substantially cylindrical outer circumferential surface which is spaced a distance from said internal surface to form a slot therebetween to reduce underpressure at the center of the impeller, a primary cutting means having at least two substantially axially extending cutting portions on said part projecting radially outwardly from the said cylindrical surface, each of said primary cutting portions having a surface inclined relative to the longitudinal axis of said impeller which cooperates with edges of said internal surface which forms said grooves to cut the objects, at least one secondary cutting means having a surface projecting radially outwardly from said substantially cylindrical outer circumferential surface and up to one edge of said central inlet opening and cooperating with the edges of said internal surface which forms said grooves to cut the objects, and a projection extending axially outside of said inlet opening from each of said primary cutting portions to create a flow pattern to direct the solid objects to said primary cutting portions.

2. The pump of claim 1 wherein each of said projections is rounded.

3. The pump of claim 1 wherein said secondary cutting means extends over a shorter axial distance than said primary cutting means.

4. The pump of claim 1 wherein said outer diameter of said part is 75–95% of that of said inlet.

5. The pump of claim 4 wherein said outer diameter of said part is 80–95% of that of said inlet.

* * * * *